10/8/85 X9 4,545,825

United States Patent [19]

Miyata et al.

[11] Patent Number: 4,545,825

[45] Date of Patent: Oct. 8, 1985

[54] APEX SEALS FOR HIGH POWER ROTARY PISTON ENGINES

[75] Inventors: Jun Miyata; Koji Yagii; Tsutomu Shimizu, all of Hiroshima, Japan

[73] Assignee: Mazda Motor Corporation, Hiroshima, Japan

[21] Appl. No.: 593,134

[22] Filed: Mar. 26, 1984

[30] Foreign Application Priority Data

Mar. 26, 1983 [JP] Japan ..... 58-51080

[51] Int. Cl.[4] ..... C21D 5/00

[52] U.S. Cl. ..... 148/3; 148/35; 148/39

[58] Field of Search ..... 148/35, 141, 39, 3; 75/123 CB, 128 D, 65 EB

[56] References Cited

U.S. PATENT DOCUMENTS

| | | | |
|---|---|---|---|
| 3,658,451 | 4/1972 | Gomada | 418/178 |
| 3,802,927 | 4/1974 | Gomada | 148/35 |
| 3,830,601 | 8/1974 | Yamazaki | 148/35 |
| 4,125,399 | 11/1978 | Kizu et al. | 75/125 |
| 4,153,477 | 5/1979 | Beyer et al. | 148/35 |

FOREIGN PATENT DOCUMENTS

| | | | |
|---|---|---|---|
| 2244220 | 3/1973 | Fed. Rep. of Germany | 75/65 EB |
| 2428821 | 12/1975 | Fed. Rep. of Germany | 75/123 CB |

*Primary Examiner*—Peter K. Skiff

*Attorney, Agent, or Firm*—Fleit, Jacobson, Cohn & Price

[57] ABSTRACT

An apex seal for rotary piston engines comprising a material containing in weight 2.5 to 4.0% of C, 1.5 to 3.0% of Si, less than 1.0% of Mn, 0.25 to 2.0% of Ni, 0.25 to 2.0% of Mo, 0.25 to 2.0% of Cu, 0.05 to 0.3% of B, 0.2 to 1.5% of Cr, 0.05 to 1.0% of V and balance substantially of Fe. The sliding surface portion of the seal is of a chilled structure containing in area ratio more than 55% of carbides and the body portion is essentially of bainite structure containing in area ratio less than 15% of carbides.

5 Claims, 7 Drawing Figures

APEX SEALS FOR HIGH POWER ROTARY PISTON ENGINES

The present invention relates to apex seals for rotary piston engines and more particularly to apex seals for high power rotary piston engines. More specifically, the present invention pertains to apex seals of such materials that have both wear-resistant and thermal shock resistant properties.

Conventional rotary piston engines comprise a casing which includes a rotor housing having an inner wall of trochoidal configuration and a pair of side housings gas-tightly secured to the opposite sides of the rotor housing to define a rotor cavity of trochoidal configuration. In the rotor housing, there is rotatably disposed a rotor of polygonal or usually a triangular configuration. The rotor includes a plurality of apex portions which are adapted to slidably engage in the inner wall of the rotor housing so as to divide the rotor cavity into a plurality of working chambers having volumes which vary in response to the rotation of the rotor.

In order to provide a gas-tight seal across the adjacent working chambers, the rotor is provided at each apex portion with a so-called apex seal. For the purpose, each apex portion of the rotor has an axially extending seal groove in which an elongated seal is received. The seal is resiliently biased against the inner wall of the rotor for sliding engagement therewith and moves along the inner wall of the rotor at a substantial speed as the rotary engine is operated. Thus, the apex seal must be of a highly wear-resistant material which is also durable to heat applied by engine combustion gas and produced in the seal due to the friction between the apex seal and the rotor housing wall. Further, in a high power rotary piston engine equipped with a supercharger, the apex seal must be highly resistant to thermal shock.

Hithertofore, it has been proposed for example by the U.S. Pat. No. 4,125,399 to cast an apex seal with a cast iron material containing B so that a chilled structure is formed throughout the body of the apex seal to provide a high wear-resistant property. It should however be noted that the conventional apex seal is insufficient in the resistance to a thermal shock so that cracks are often produced under repeated heating and cooling cycles to which apex seals of rotary piston engines are usually subjected in use. This is because the proposed apex seal has carbides educed throughout the body thereof so that it has a poor thermal conductivity.

There has also been made another proposal by the U.S. Pat. No. 3,658,451 to cast an apex seal by a cast iron material without B content and form a chilled structure only at the sliding surface portion. The proposed apex seal has a satisfactory resistance to thermal shock, however, a sufficient quantity of carbides is not educed at the sliding surface portion due to the lack of B content so that it has not been possible to obtain a satisfactory wear-resistant property.

It is therefore an object of the present invention to provide an apex seal for rotary piston engines which has both the wear-resistant and thermal shock-resistant properties.

Another object of the present invention is to provide an apex seal which can be used for high power rotary piston engines.

According to the present invention, the above and other objects can be accomplished by an apex seal for rotary piston engines having a body portion and a sliding surface portion which is adapted to be brought into sliding contact with an inner wall surface of a rotor housing of the rotary piston engine, said apex seal comprised of a material containing in weight 2.5 to 4.0% of C, 1.5 to 3.0% of Si, less than 1.0% of Mn, 0.25 to 2.0% of Ni, 0.25 to 2.0% of Mo, 0.25 to 2.0% of Cu, 0.05 to 0.3% of B, 0.2 to 1.5% of Cr, 0.05 to 1.0% of V and balance substantially of Fe, said sliding surface portion being of a chilled structure containing in area ratio more than 55% of carbides, said body portion being essentially of bainite structure containing in area ratio less than 15% of carbides.

According to another aspect of the present invention, there is provided a process for manufacturing an apex seal for rotary piston engines having a body portion and a sliding surface portion which is adapted to be brought into sliding contact with an inner wall surface of a rotor housing of the rotary piston engine, said process including steps of casting a blank of the apex seal by a material containing in weight 2.5 to 4.0% of C, 1.5 to 3.0% of Si, less than 1.0% of Mn, 0.25 to 2.0% of Ni, 0.25 to 2.0% of Mo, 0.25 to 2.0% of Cu, 0.005 to 0.3% of B, 0.2 to 1.5% of Cr, 0.05 to 1.0% of V and balance substantially of Fe, heating the blank under a temperature of 900° to 1050° C. for more than 5 hours, melting and quenching a surface portion of the blank to produce a chilled structure at the surface portion to thereby provide said sliding surface portion.

According to the present invention, the sliding surface portion of the apex seal contains more than 55% in area of carbides as described above. With the carbides content less than 55% in area, it is impossible to obtain an adequate wear resistant property. Further, the body portion of the apex seal contains less than 15% in area of carbides since the carbides content above this value causes a decrease in the thermal conductivity and therefore has an adverse effect on the resistance to a thermal shock. Since the body portion of the apex seal is essentially of a bainite structure which is in general known as having a high tenacity and a high bending strength. Moreover, the bainite structure has a certain degree of hardness so that the body portion of the apex seal in accordance with the present invention can possess a mechanical strength required for the apex seal as well as a resistance to wear to which the body portion is subjected by being brought into contact with the seal groove wall in the rotor apex portion.

With regard to the carbon content in the material, a satisfactory wear resistant property cannot be obtained with the carbon content less than 2.5% in weight since a sufficient quantity of carbides cannot be produced in the sliding surface portion. With the carbon content greater than 4.0%, an excessive amount of eutectic crystals will be produced and the material will become too brittle. With the Si content less than 1.5%, the body portion will be excessively chilled resulting in a poor thermal shock resistance. A silicon content greater than 3.0% produces an excessive amount of graphite making the material difficult to chill. Manganese is added for the purpose of desulfurizing but the Mn content greater than 1.0% makes the material brittle. Ni, Mo and Cu are added for strengthening the body portion but the effect will not be sufficient with the content less than 0.25%. The content over 2.0% does not produce any further improvement so that the additives are wasted.

The B content has a significant effect in producing the carbides and making the carbides particles fine.

However, with the B content less than 0.5% in weight does not provide an adequate wear-resistant property since the chilled structure cannot satisfactorily be produced. The B content greater than 0.3% makes the material brittle and has an adverse effect on the thermal shock resistance. Chromium is added because it is effective to educe carbides. As described above, it is necessary to limit the B content in order to avoid the aforementioned adverse effects so that a satisfactory wear resistant property cannot be obtained only by the B content. Chromium is therefore added to provide the material with additional wear-resistant property. With the Cr content less than 0.2%, an adequate improvement cannot be obtained but the Cr content greater than 1.5% will have an adverse effect on the machining property. The V content also has an effect of educing carbides and consequently provides an improved wear resistant property. Further, the V content is effective to make the structure fine. With the V content less than 0.05%, an adequate improvement cannot be obtained but the V content greater than 1.0% will produce an excessive quantity of carbides making the material brittle.

In addition to the aforementioned contents, magnesium may further be added for the purpose of stabilizing the chilled structure. The Mg content in this instance may be 0.005 to 0.05% in weight.

In the process of manufacturing the apex seal in accordance with the present invention, graphite is educed in the heating step and there is produced essentially the bainite structure including carbides less than 15% in area. The heating temperature lower than 900° C. cannot produce graphite in a satisfactory manner but the temperature above 1050° C. is not recommendable because the temperature is too close to the melting point of the material. The heating time of 5 hours or more is required for obtaining a desired eduction of graphite. In melting the surface portion, electron beams may be applied to the material.

The above and other objects and features of the present invention will become apparent from the following descriptions of a preferred embodiment taking reference to the accompanying drawings, in which.

Figure 1:
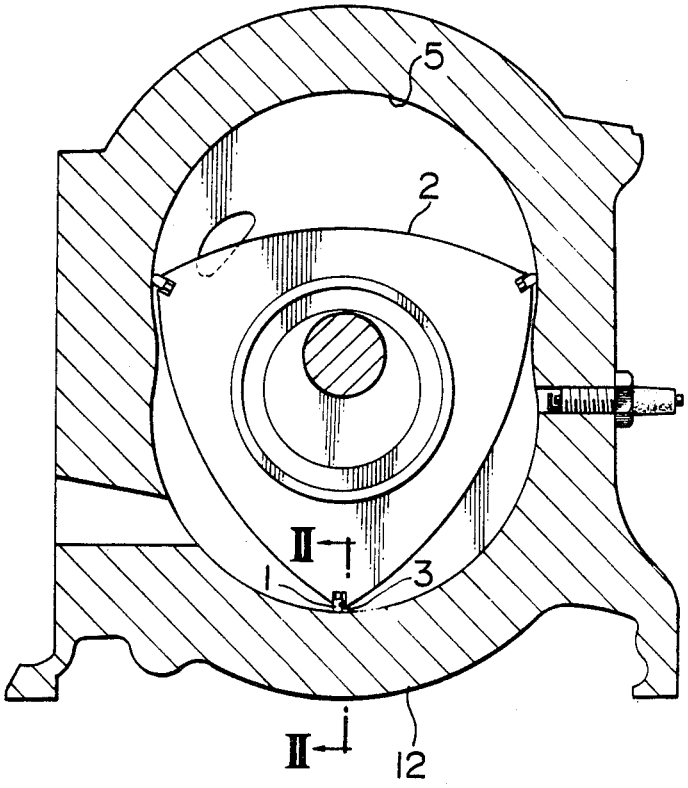
FIG. 1 is a sectional view of a rotary piston engine having a rotor carrying apex seals.
Figure 2:
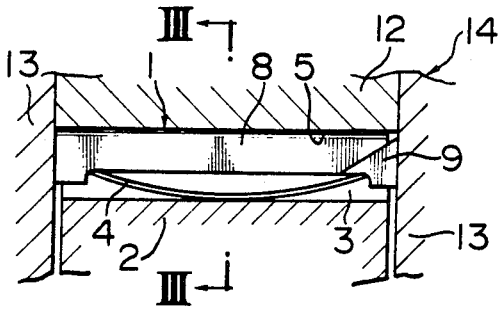
FIG. 2 is a sectional view taken along the line II—II in FIG. 1.
Figure 3:
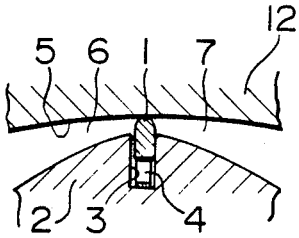
FIG. 3 is a sectional view taken along the line III—III in FIG. 2.
Figure 4:
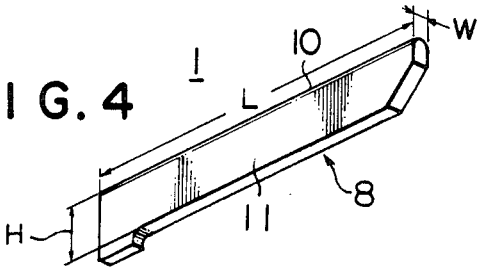
FIG. 4 is a perspective view of the apex seal.

Referring to the drawings, particularly to FIGS. 1 through 3, the rotary piston engine shown therein includes a casing 14 which comprises a rotor housing 12 having an inner wall 5 of trochoidal configuration and a pair of side housings 13 secured to the opposite sides of the rotor housing 12. In the casing 14, there is disposed a rotor 2 of triangular configuration. The rotor is formed at each apex portion with a groove 3 in which an apex seal 1 is received. The apex seal 1 is comprised of a main piece 8 and an end piece 9 and biased radially outwardly by means of a spring 4 which acts on the main piece 8 and a wedge-shaped end piece 9. Thus, the apex seal 1 is forced into contact with the inner wall 5 of the rotor housing 12 and separates working chambers 6 and 7. The present invention can be applied to the main piece 8 of the apex seal 1. As shown in FIG. 4, the main piece 8 of the apex seal 1 includes a body portion 11 and a sliding surface portion 10 which is adapted to be brought into a sliding contact with the inner wall 5 of the rotor housing 12.

EXAMPLES

Test samples $S_1$ through $S_8$ of the main piece 8 of the apex seal 1 are prepared from the materials listed in Table 1 in the following procedures.

TABLE 1

| | C | Si | Mn | P | S | Cr | Mo | Ni | Cu | B | V | Mg | Fe |
|---|---|---|---|---|---|---|---|---|---|---|---|---|---|
| S 1 | 3.48 | 2.36 | 0.35 | 0.18 | 0.02 | 0.47 | 1.67 | 1.05 | 1.12 | 0.05 | 0.20 | 0.018 | Balance |
| S 2 | 3.49 | 2.38 | 0.32 | 0.20 | 0.02 | 0.48 | 1.65 | 1.04 | 1.11 | 0.19 | 0.18 | 0.019 | " |
| S 3 | 3.48 | 2.41 | 0.40 | 0.19 | 0.02 | 0.48 | 1.61 | 1.02 | 1.10 | 0.30 | 0.17 | 0.018 | " |
| S 4 | 3.46 | 2.39 | 0.36 | 0.21 | 0.02 | 0.47 | 1.62 | 1.03 | 1.09 | 0.03 | 0.19 | 0.011 | " |
| S 5 | 3.51 | 2.39 | 0.39 | 0.18 | 0.02 | 0.47 | 1.65 | 1.01 | 1.12 | 0.48 | 0.20 | 0.019 | " |
| S 6 | 3.45 | 1.00 | 0.50 | — | — | 1.00 | 2.00 | 3.50 | — | 0.40 | 0.15 | — | " |
| S 7 | 2.89 | 1.18 | 0.91 | — | — | — | 1.23 | 2.45 | — | 0.70 | 0.20 | — | " |
| S 8 | 3.48 | 2.38 | 0.38 | 0.19 | 0.02 | 0.45 | 1.67 | 1.01 | 1.09 | — | 0.19 | 0.015 | " |

Samples $S_1$ through $S_3$:

These samples are embodiments of the present invention and molten materials under 1500° to 1520° C. are inoculated with a commercially available Fe-Si alloy, and the resultant materials are then poured into shell moulds under a temperature of 1390° to 1400° C. to produce moulded blanks. The blanks are then heated in a furnace to 950° C. and maintained in that temperature for 6 hours, and thereafter cooled in the furnace. The sliding surface portions 10 of the blanks are then locally molten by applying electron beams and quenched to produce chilled structures. Finally the blanks are machined to produce the main pieces.

Samples $S_4$ and $S_5$:

These samples are for comparative tests and produced with the same process as in the samples $S_1$ through $S_3$. The sample $S_4$ contains boron the content is less than the lower limit in the present invention. In the sample $S_5$, the boron content is greater than the upper limit of the present invention.

Samples $S_6$ and $S_7$ (Prior Art):

The materials are moulded in shell moulds having quenching metals so that carbides are educed throughout the body of the blanks to produce chilled structures.

Sample $S_8$ (Prior Art):

The material does not contain boron. After casting, the blank is not subjected to a heating treatment but the surface portion is chilled by applying electron beams and thereafter quenching.

The samples $S_1$ through $S_8$ are then subjected to the following tests.

WEAR TEST:

(1) Test method:

Sliding wear tests are carried out by bringing the samples into sliding contacts at the sliding surfaces 10 under a pressure with a rotating disc having a Cr plated surface and measuring the wear in hightwise direction of the samples.

(2) Test conditions:

Dimensions of the Samples (Refer to FIG. 4):

Width W: 3 mm

Hight H: 8 mm

Length L: 10 mm

Pressure: 4.5 kg

Rotating Speed of the Disc: 5 m/sec.

Time: 20 min.

THERMAL SHOCK TEST:

(1) Test Method:

Each of the samples is subjected to twenty thermal cycles, each cycle comprising the steps of heating the sample to 380° C. and then quenching in water, and the sample is then examined with respect to the existence of cracks.

(2) Test Conditions:

Dimensions of the Samples: Same as above.

Number of Samples Tested: One hundred for each test sample.

The results of the tests are shown in Table 2.

TABLE 2

| | Heat Treat After Casting | B Content (% in Weight) | Hardnesss (Hv) After Casting | After Heat Treat | Chilled Structure | Test Results Wear (μ) | Cracked Samples (%) |
|---|---|---|---|---|---|---|---|
| S 1 | YES | 0.05 | 400 | 271 | 918 | 46 | 1.0 |
| S 2 | YES | 0.19 | 421 | 289 | 930 | 42 | 3.0 |
| S 3 | YES | 0.30 | 480 | 293 | 950 | 35 | 4.0 |
| S 4 | YES | 0.03 | 395 | 270 | 909 | 69 | 6.0 |
| S 5 | YES | 0.48 | 484 | 325 | 971 | 21 | 39.0 |
| S 6 | NO | 0.40 | 810 | — | 810 | 50 | 50.0 |
| S 7 | NO | 0.70 | 826 | — | 826 | 40 | 100 |
| S 8 | NO | — | 367 | — | 790 | 82 | 3.0 |
| Allowable Limit | | | | | | 60μ Below | 20% Below |

In Table 2, it will be apparent that the test samples $S_1$ through $S_3$ in accordance with the present invention meets the requirements in respect of both the wear and thermal shock resistance. The sample $S_4$ is dissatisfactory in respect of wear resistant property due to the insufficient quantity of boron content, whereas the samples $S_5$ shows a poor thermal shock resistance due to the excessive quantity of boron. It will further by noted that the samples $S_6$ and $S_7$ show very poor thermal shock resistance since they have chilled structures of low thermal conductivity throughout the body. The sample $S_8$ shows a very low wear resistance because it has less amount of carbides educed in the sliding surface portion.

In order to examine the effect of the heat treatment after the moulding step, test pieces 1 through 6 are prepared from the material as in the test sample $S_2$. The test pieces are subjected to heat treatments under different temperatures and different treating times and then subjected to hardness tests. The results are shown in Table 3.

| | Temp. (°C.) | Time (hr) | Hardness after Casting (Hv) | Hardness after Heat Treatment (Hv) |
|---|---|---|---|---|
| No. 1 | 750 | 3 | 425 | 415 |
| No. 2 | 750 | 6 | 420 | 396 |
| No. 3 | 750 | 8 | 418 | 392 |
| No. 4 | 950 | 3 | 420 | 397 |
| No. 5 | 950 | 6 | 421 | 289 |
| No. 6 | 950 | 8 | 420 | 285 |

-continued

| | Temp. (°C.) | Time (hr) | Hardness after Casting (Hv) | Hardness after Heat Treatment (Hv) |
|---|---|---|---|---|
| Allowable Limit | | | | 380 |

In the Table 3, it will be noted that the test pieces 1 through 3 which are heat treated under the temperature of 750° C. show hardness values which are dissatisfactorily higher than the allowable limit. This is understood as being caused by an insufficient dissolution of carbides. These values show that the test pieces have poor thermal shock resistances. The test piece 4 also shows a dissatisfactorily high hardness value due to an insufficient heating time. By the contrary, the test pieces 5 and 6 which are heat treated in accordance with the present invention show satisfactory hardness values.

Figure 5:
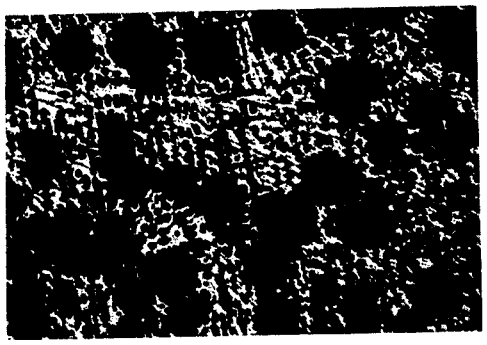
FIGS. 5 through 7 are microscopic photographs of the structures in the apex seal respectively after the casting step, the heating step and the chilling step.
Figure 6:
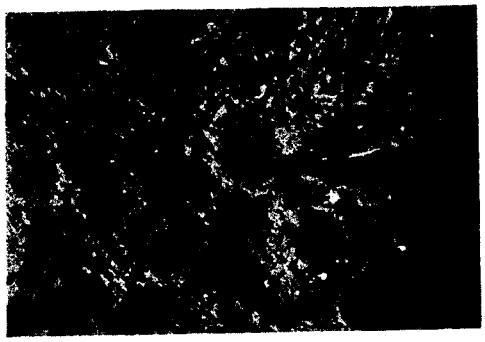
Figure 7:
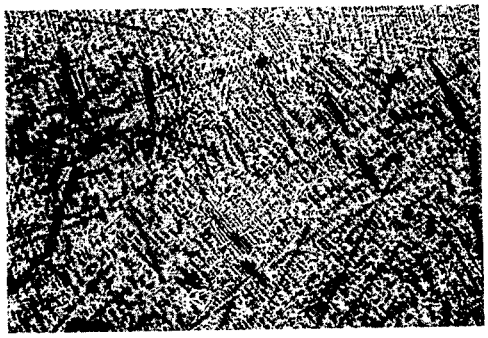

In FIGS. 5 through 7, there are shown microscopic photographs in one hundred magnification of the sample $S_2$ respectively after the casting, after the heating step and after the chilling step. In FIG. 5 which shows the material after the casting step, the black areas show graphite, the gray area a portion which is comprised essentially of bainite structure partially containing perlite structure, and the white area composite carbides.

In FIG. 6 which shows the material after the heat treatment, it will be noted that the area of the composite carbides is decreased to approximately 10% of the total area and graphite is educed. In FIG. 7, the gray area shows a martensite structure whereas the white area shows composite carbides.

The invention has thus been shown and described with reference to specific examples, however, it should be noted that the invention is in no way limited to the details of the described examples but changes and modifications may be made within the scope of the appended claims.

We claim:

1. An apex seal for rotary piston engines having a body portion and a sliding surface portion which is adapted to be brought into sliding contact with an inner wall surface of a rotor housing of the rotary piston engine, said apex seal comprised of a material containing by weight, 2.5 to 4.0% of C, 1.5 to 3.0% of Si, less than 1.0% of Mn, 0.25 to 2.0% of Ni, 0.25 to 2.0% of Mo, 0.25 to 2.0% of Cu, 0.05 to 0.3% of B, 0.2 to 1.5% of Cr, 0.05 to 1.0% of V and a balance substantially of Fe, said sliding surface portion being of a chilled structure containing in area ratio more than 55% of carbides, said body portion being essentially of bainite structure containing in area ratio less tan 15% of carbides.

2. An apex seal in accordance with claim 1, wherein said material further contains 0.005 to 0.05% by weight of Mg.

3. A process for manufacturing an apex seal for rotary piston engines having a body portion and a sliding surface portion which is adapted to be brought into sliding contact with an inner wall surface of a rotor housing of the rotary piston engine, said process including the steps of casting a blank of the apex seal comprised of a material containing by weight 2.5 to 4.0% of C, 1.5 to 3.0% of Si, less than 1.0% of Mn, 0.25 to 2.0% of Ni, 0.25 to 2.0% of Mo, 0.25 to 2.0% of Cu, 0.005 to 0.3% of B, 0.2 to 1.5% of Cr, 0.05 to 1.0% of V and balance substantially of Fe; heating the blank in a furnace under a temperature of 900° to 1050° C. for more than 5 hours and cooling the blank in the furnace to produce a body portion, which body portion is essentially of a bainite structure containing in area ratio less than 15% of carbides; and melting and quenching a surface portion of the blank to produce a chilled structure at the surface portion to thereby provide said sliding surface portion, which sliding surface portion has a chilled structure containing in area ratio more than 55% of carbides.

4. A process in accordance with claim 3, wherein the material further contains 0.005 to 0.05% by weight of Mg.

5. A process in accordance with claim 3, wherein the blank is melted at the surface portion by applying thereto electron beams.

* * * * *